US011439254B1

(12) United States Patent
Kacines

(10) Patent No.: US 11,439,254 B1
(45) Date of Patent: Sep. 13, 2022

(54) TIERED ORNAMENT TREE

(71) Applicant: Jeffery J. Kacines, Allen, TX (US)

(72) Inventor: Jeffery J. Kacines, Allen, TX (US)

( * ) Notice: Subject to any disclaimer, the term of this patent is extended or adjusted under 35 U.S.C. 154(b) by 0 days.

(21) Appl. No.: 17/225,337

(22) Filed: Apr. 8, 2021

(51) Int. Cl.
*A47F 5/04* (2006.01)
*A47G 33/06* (2006.01)
*D06F 57/04* (2006.01)

(52) U.S. Cl.
CPC ..... *A47F 5/04* (2013.01); *A47G 33/06* (2013.01); *D06F 57/04* (2013.01)

(58) Field of Classification Search
CPC ..... A47F 5/04; A47F 5/05; A47F 5/06; A47F 5/106; A47G 33/06; A47G 25/0664; D06F 57/04; Y10T 403/7062; Y10T 403/7067; Y10T 403/7069
USPC ..... 211/196, 197, 205, 172, 107, 1.3, 2; 248/158; 403/373, 374.3, 374.4
See application file for complete search history.

(56) References Cited

U.S. PATENT DOCUMENTS 279,810 A * 6/1883 Richards ..... F16M 11/10 248/125.1
983,589 A * 2/1911 Wendt ..... A47G 25/0664 211/196
1,038,198 A * 9/1912 Randall et al. ..... A47F 5/04 211/205
1,089,290 A * 3/1914 Thompson ..... F16M 11/00 248/165
1,292,931 A * 1/1919 Van Etten ..... A47G 25/0664 211/196
1,387,765 A * 8/1921 Colonna ..... A47F 5/06 211/168
1,501,258 A * 7/1924 Wolfe ..... F16B 9/058 403/189
1,525,701 A * 2/1925 Rose ..... A47G 25/0664 211/196
1,613,386 A 1/1927 Ekdahl
1,697,866 A * 1/1929 Hansen ..... A47F 5/04 211/165
1,711,587 A * 5/1929 Brunhoff ..... A47F 5/02 211/168
1,729,004 A * 9/1929 Miadowicz ..... A47F 5/04 211/166
2,065,622 A * 12/1936 Smith ..... A47G 25/0664 211/205
2,130,961 A * 9/1938 Leggett ..... A01F 25/12 211/29
2,253,286 A * 8/1941 Cronan ..... A47G 25/0607 211/115
2,309,190 A * 1/1943 Heller ..... A47G 23/08 211/132.1
2,325,191 A 7/1943 Mortimer
2,447,924 A * 8/1948 Vitale ..... A47G 25/0664 211/205

(Continued)

*Primary Examiner* — Jennifer E. Novosad
(74) *Attorney, Agent, or Firm* — Roger N. Chauza, PC

(57) ABSTRACT

A tiered ornament tree having one or more tiers of hook members from which ornaments are displayed. Each tier includes a castellated collar with slots formed in a top edge thereof, and plural hook members with inner ends inserted in each slot of the castellated collar. The collar and associated hook members of a tier are captured between threaded ends of threaded rods. The bottom end of the ornament tree is fastened to a base, and a top end of the ornament tree is equipped with a finial.

20 Claims, 7 Drawing Sheets

(56) References Cited

U.S. PATENT DOCUMENTS 2,597,157 A * 5/1952 Martino ..... A47G 25/08 248/150
2,618,902 A * 11/1952 Prescott ..... A01G 9/128 47/47
2,922,031 A 1/1960 Stiffel
3,015,024 A * 12/1961 Charchan ..... A47G 7/042 362/227
3,021,960 A * 2/1962 Pipe ..... A47B 13/06 211/205
3,035,707 A * 5/1962 Thompson ..... A47G 23/08 211/78
3,197,034 A * 7/1965 Deadrick ..... A47G 25/0664 211/205
3,285,554 A * 11/1966 Voelkerding ..... E01F 9/685 248/121
3,339,752 A * 9/1967 Trogan ..... A47F 5/06 211/194
3,603,780 A 9/1971 Lu
3,788,489 A * 1/1974 Levinthal ..... A47F 5/04 211/163
3,828,373 A * 8/1974 Fraley ..... A47K 1/02 4/646
3,844,873 A 10/1974 Dalske et al.
3,970,834 A 7/1976 Smith
4,453,640 A * 6/1984 Cillario ..... A47F 5/13 211/133.4
4,462,065 A 7/1984 Rhodes
4,767,088 A * 8/1988 Fielder ..... A01K 39/0113 119/57.9
4,770,303 A * 9/1988 Boyd ..... A47G 7/042 211/118
4,807,837 A * 2/1989 Gawlik ..... A61M 5/1415 211/196
4,908,244 A 3/1990 Bullock
4,953,713 A * 9/1990 Yaffe ..... A47F 5/04 206/460
4,991,344 A * 2/1991 Carney ..... A47G 7/042 211/133.2
5,037,049 A * 8/1991 Funk ..... A47F 5/01 248/165
5,065,871 A * 11/1991 Chan ..... A47F 7/08 211/37
5,071,098 A 12/1991 Aldridge
5,150,874 A * 9/1992 Spiegel ..... A41G 1/007 211/205
5,219,081 A * 6/1993 Lin ..... A47G 25/0664 211/196
5,318,189 A * 6/1994 Lee ..... A47G 25/0664 211/196
5,487,476 A * 1/1996 Barfield ..... A47F 7/0078 211/205
5,772,050 A * 6/1998 Shih ..... B41K 1/58 211/163
5,873,195 A * 2/1999 Wortham ..... A47G 7/042 47/39
6,386,491 B1 * 5/2002 Bissett ..... A47F 5/04 211/205
D461,142 S 8/2002 Capstick
6,568,546 B1 * 5/2003 Huang ..... A47B 49/00 211/205
6,698,598 B1 * 3/2004 Appenteng ..... A47F 5/02 211/168
6,736,358 B2 * 5/2004 Johnson ..... A45F 3/44 248/125.3
7,374,136 B1 * 5/2008 Perea ..... A47F 5/04 248/121
7,458,475 B2 * 12/2008 Ho ..... A47G 7/041 211/182
8,201,783 B1 * 6/2012 Bamburg, Jr. ..... A47G 7/041 248/150
8,240,488 B2 * 8/2012 Huang ..... B05B 13/0292 211/107
8,418,403 B1 * 4/2013 Nuttman ..... A01G 9/024 47/82
8,720,706 B2 * 5/2014 Robbins, III ..... A47F 5/02 211/163
8,968,843 B1 3/2015 Madrid et al.
9,095,974 B2 * 8/2015 Verson ..... A47F 7/00
9,320,206 B2 * 4/2016 Ganske ..... A01G 9/00
9,492,020 B1 * 11/2016 Morrell ..... A47F 5/0018
10,016,077 B1 * 7/2018 Carney ..... A47G 7/045
10,219,605 B1 * 3/2019 Love ..... A47B 96/1483
10,323,792 B2 * 6/2019 Zoutman ..... A01K 3/00
10,422,470 B2 * 9/2019 Cote ..... F16M 11/16
10,729,226 B1 * 8/2020 Zamora ..... A45F 3/44
11,046,380 B1 * 6/2021 Gu ..... B62H 3/06
2003/0164348 A1 * 9/2003 Seng ..... D06F 57/04 211/196
2005/0082244 A1 * 4/2005 Ho ..... A47G 7/041 211/85.23
2005/0247837 A1 11/2005 Spencer
2006/0165482 A1 * 7/2006 Olberding ..... E04B 1/24 403/381
2008/0050541 A1 2/2008 Trowbridge
2011/0089127 A1 * 4/2011 Thomas ..... A47F 5/02 211/163
2012/0055893 A1 * 3/2012 Wisniewski ..... A47G 25/0664 211/85.3

* cited by examiner

TIERED ORNAMENT TREE

TECHNICAL FIELD OF THE INVENTION

The present invention relates in general to ornament displays, and more particularly to display trees with one or more tiers of branches from which ornaments are hung.

BACKGROUND OF THE INVENTION

It is a common practice to display ornaments to enhance or celebrate a holiday or the spirit of a holiday. The ornaments can be displayed individually, or collectively. In order to conserve space, ornament trees are available to hang multiple ornaments thereon so that all the ornaments, whether the same or different, can be displayed in a small footprint of space.

Ornament trees generally include a base and a vertical trunk to which various layers or tiers of limbs are attached. The branches of the limbs are constructed to hang therefrom the ornaments. Ornament trees of various types are illustrated in the following U.S. Pat. Nos. 1,613,386; 2,325,191; 4,462,065; 4,908,244; D461,142 and 8,968,843.

One problem with the design and fabrication of ornament trees is that the tree is bulky and delicate and thus difficult to ship. When fabricated as a single integral three-dimensional article, then a large box or container is required. Often, in order to prevent breakage of the tree when shipped, a soft packing material is necessary to cushion the tree.

An important consideration in the design of an ornament tree is its simplicity and versatility. The simplicity relates to the overall cost of producing the ornament tree, and the versatility relates to the different configurations the ornament tree can assume for adaption to different situations.

From the foregoing, it can be seen that a need exists for an ornament tree that requires only five different components, and the tiers can be added by just adding more of the same components until the desired number of tiers are achieved. Further, different numbers of branches can be used for the different tiers of the ornament tree. Another need exists for an ornament tree that is easily assembled, and with different configurations to adapt to different situations. Another need exists for the fabrication of an ornament tree that is completely available in its component parts which can be shipped without the concern of breakage.

SUMMARY OF THE INVENTION

In accordance with the principles and concepts of the invention, disclosed is an ornament tree constructed of various component parts which, when assembled together, provides a three dimensional tree with branches from which to hang or engage objects to be displayed. The ornament tree of the invention can be fabricated and shipped as component parts, thus allowing smaller shipping packages to be employed, and damage during shipping is reduced.

According to a feature of the invention, disclosed is an ornament tree that is versatile in that multiple tiers of hangers can be utilized so that many objects can be displayed. Each tier effectively includes the same components to thereby reduce the number of different components that need to be fabricated, and thus make the ornament tree more cost effective.

With regard to a further feature of the invention, each tier of the ornament tree is connected to an underlying support rod and an overlying support rod. The ornament tree can be assembled using a collar that has vertical channels and corresponding slots therein for receiving an inner end of each hook member. The inner end of the hook member is inserted in the channel of the collar and extends through the slot. The underlying and overlying support rods are then connected to the corresponding top and bottom of the collar to thereby capture the inner end of each hook member thereto.

The support rods are identical, each having a threaded bore at one end and a threaded stud at the other end. The bottommost support rod can be threadably fastened to a base, and the topmost support rod can be connected to a decorative finial, with the various tiers of hook members located therebetween.

In accordance with an embodiment of the invention, disclosed is an ornament tree that includes a base adapted for resting on a support surface. A male/female threaded rod is attached to the base. Further included is a collar attachable to a top end of the male/female rod, where the collar has one or more vertical slots formed therein. One or more hook members are included. Each of the hook members is adapted for engaging with an ornament, and each hook member has an inner end adapted for insertion in a respective slot of the collar. A finial is threadably attached to the top end of the threaded rod, where the finial captures the inner ends of the hook members within the respective vertical slots of the collar to prevent vertical removal of the inner ends of the hook members.

In accordance with a further embodiment of the invention, disclosed is an ornament tree that includes a base adapted for resting on a support surface, and a finial located at a top of the ornament tree. Further included is a plurality of threaded rods, where each of the threaded rods has at one end a threaded bore and at an opposite end a threaded stud. The plurality of threaded rods is threadably connected in series, with a bottommost threaded rod of the plurality of threaded rods threadably connected to the base, and a topmost threaded rod of the plurality of threaded rods is threadably connected to the finial. Also included is one or more tiers of hook members, where each tier includes; a) a cylindrical collar insertable over a threaded stud of a threaded rod of the plurality of threaded rods, where the collar is castellated and has one or more vertical slots formed in an annular edge of the collar, b) a set of hook members, where each hook member has an outer end adapted for engaging with an ornament, and each hook member has an inner end adapted for insertion in a respective slot of the cylindrical collar, and c) a threaded bore of either a threaded rod or the finial threadably attached to the threaded stud over which the cylindrical collar is inserted to cap an end of each slot to thereby capture the respective inner ends of the hook members in the cylindrical collar.

In accordance with another embodiment of the invention, disclosed is an ornament tree that includes a base adapted for resting on a support surface, and a plurality of threaded rods forming a vertical support for the ornament tree. At least two of the threaded rods have at one end a threaded stud and at an opposite end a threaded bore. A bottommost of the threaded rods of the plurality is fastened to the base. Provided is a tiered arrangement of at least two sets of hook members, where each hook member of each set is adapted for engaging with an ornament. The tiered arrangement includes a) a first tier which includes a first tubular castellated collar having vertical slots in a top end thereof, where the first tubular castellated collar is insertable onto the threaded stud of a first threaded rod of the at least two threaded rods. Further included is a first set of hook members, where each hook member of the first set has an inner end that is insertable in a respective slot of the first tubular castellated collar. The tiered arrangement further includes b) a second tier which includes a second tubular castellated collar having vertical slots in a top end thereof, and the second tubular castellated collar is insertable onto the threaded stud of a second threaded rod of the at least two threaded rods. A second set of hook members is included, where each hook member of the second set has an inner end insertable in a respective slot of the second tubular castellated collar. The threaded bore of the second threaded rod is threadably attached to the threaded stud of the first threaded rod to thereby capture the first tubular castellated collar between the first and second threaded rods. A threaded member has a threaded bore threadably attached to the threaded stud of the second threaded rod to thereby capture the second tubular castellated collar between the second threaded rod and the threaded member.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
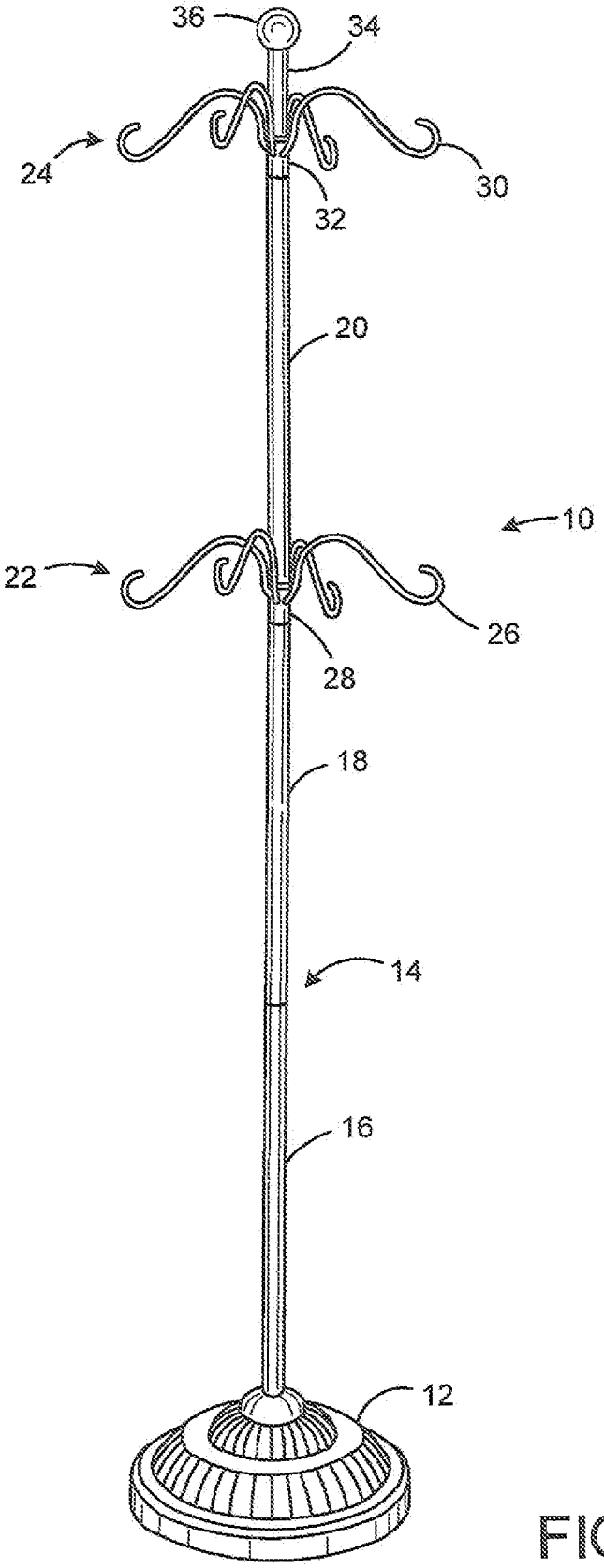
FIG. 1 is a side view of a fully assembled tiered ornament tree constructed according to the invention.

With reference to FIG. 1 of the drawings, there is illustrated a tiered ornament tree 10, constructed according to an embodiment of the invention. The ornament tree 10 includes a base 12 that has a flat bottom for resting on a support surface. An upright series of vertical support rods 14 is threadably fastened to the base 12. In the preferred embodiment, the series of support rods 14 includes a lower support rod 16, a middle support rod 18 and an upper support rod 20. Each support rod 16, 18 and 20 is constructed as a rod that has a threaded stud formed at one end and a threaded bore formed at the opposite end. In the preferred embodiment, the base 12 is constructed with an ornamental design, and with a threaded stud fastened in the center for connection to the threaded bore formed in the lower support rod 16. The threaded stud formed at the top of the lower support rod 16 is threadably fastened in the bottom threaded bore of the middle support rod 18. While two support rods 16 and 18 are employed to space the first tier 22 of hook members from the base 12, only one support rod can be employed. As an alternative, more than two support rods can be employed to space the first tier 22 of hook members from the base 12, or to provide a longer space between the tiers. The base 12 can be weighted in order to stabilize the tiered ornament tree 10 on a table, counter, dresser, mantel or other surface.

The first tier 22 includes a set of hook members 26 with respective inner ends that are embedded in a castellated collar 28. The inner ends of the hook members 26 are captured therein by an upper support rod 20 that has a bottom threaded bore fastened to the threaded stud formed at the top of the middle support rod 18. The details of the hook member inner ends and the castellated collar are described in more detail below.

The top tier 24 of the set of hook members 30 and the associated castellated collar 32 are arranged and fastened to the top of the upper support rod 20 in a similar manner. The top set of hook members 30 are fastened to the upper support 14 by the use of a finial 34 which has a bottom threaded bore that is threaded onto the top threaded stud of the upper support rod 20. At the top of the finial 34 is a decorative ball 36. Rather than a ball 36, a finger loop or other mechanism that can be grasped can be formed at the top terminal end of the finial 34.

Figure 2:
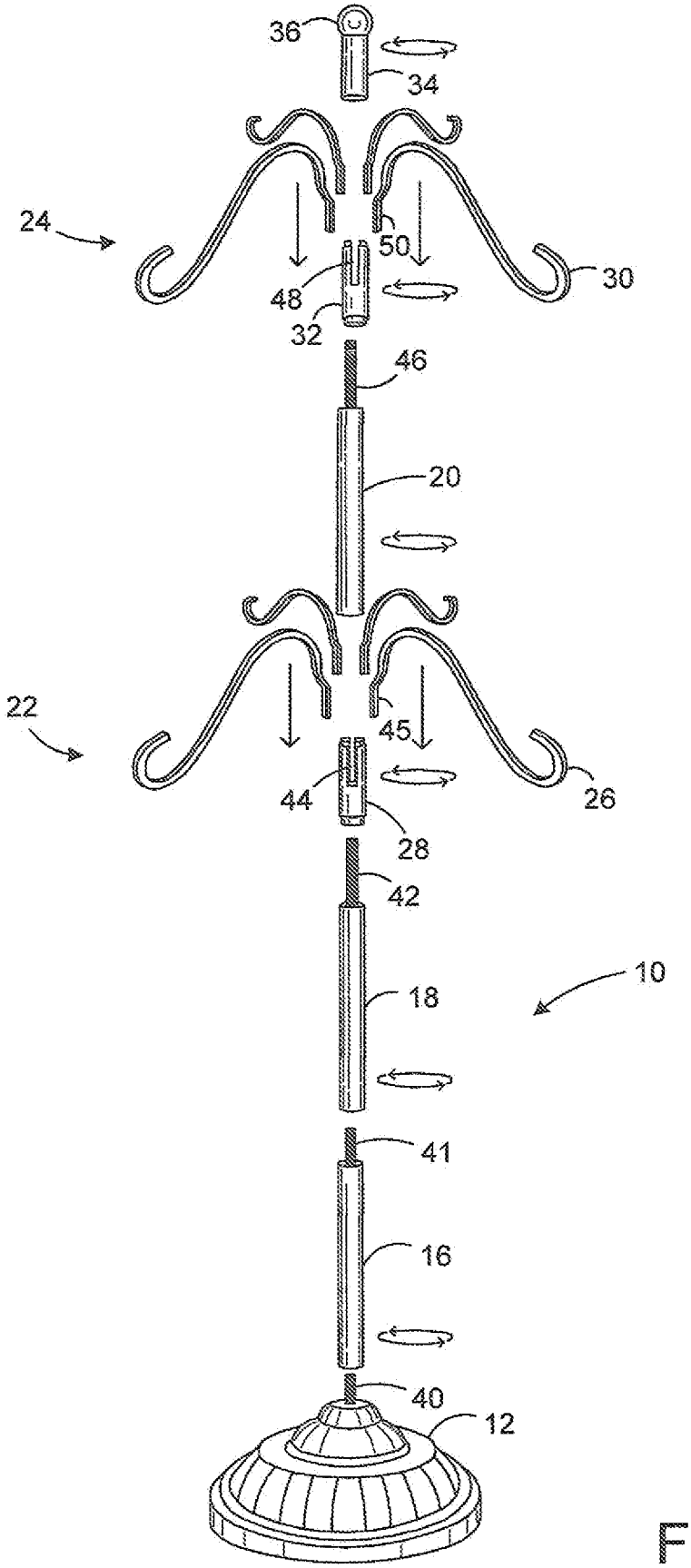
FIG. 2 is an exploded side view of the ornament tree assembled with a single tier of hook members.

Referring to FIG. 2, there is illustrated the tiered ornament tree 10 in exploded form. The base 12 is equipped with a threaded stud 40 that is fastened in the bottom threaded bore of the overlying support rod 16. In the drawings, the circular arrows indicate rotation to fasten the threaded components together, and the vertical arrows indicate the direction of movement of the components during assembly. The middle support rod 18 is threaded onto the threaded stud 41 of the underlying support rod 16. When fabricating the support rods, a bore is formed in each end of each of the support rods, and a threaded stud is threaded into one of the threaded bores. The threaded stud is longer than the depth of the threaded bore so that about half of the threaded stud extends beyond the end of the support rod. Thus, one end of the support rod has a threaded bore, and the opposite end has a threaded stud extending therefrom. While not illustrated in detail in FIG. 2, each end of each support rod is fabricated with an annular skirt, which is also described below.

The castellated collar 28 is slipped over the threaded stud 42 of the middle support rod 18, and the upper support rod 20 is then threaded onto the threaded stud 42 so as to capture the castellated collar 28 therebetween. Before the upper support rod 20 is threaded onto the threaded stud 42, the inner end 45 of one or more of the hook members 26 is inserted into a respective slot 44 of the castellated collar 28. This also captures the inner ends 45 of the hook members 26 within the castellated collar 28 and anchors the hook members 26 of the tiered ornament tree 10. The bottom tier 22 is thus completed. The upper support rod 20 can be considered a finial in the two tiered arrangement of FIG. 2, as it sits atop the first tier 22 and completes the first tier 22. The top tier 24 of the ornament tree 10 is assembled in the same manner described above, using the threaded stud 46 of the upper support rod 20, the castellated collar 32, the slots 48 and the inner end 50 of one or more top tier hook members 30. With respect to the top tier 24 of the hook members 30, the finial 34 is fastened to the threaded stud 46 to capture the castellated collar 32 and provide a decorative top. It can be appreciated that the tiered ornament tree 10 can accommodate as many tiers as desired, depending on the size and weight of the base 12.

It should be noted that the hook members 26 and 30 of the preferred embodiment each have a single outer hook from which ornaments can be hung. Those skilled in the art may prefer to utilize hook members that each have multiple hooks so that multiple ornaments can be hung from a single hook member. When using two hooks at the end of each hook member 26 or 30, the hooks can be either side by side, can include inner and outer hook, or can have one hook above the other hook, etc. Other variations are possible.

The various components of the tiered ornament tree 10 can be fabricated of steel or other sturdy and rigid material. The components can be coated with various substances to achieve desired ornamental effects. The coatings can be powder coated, painted, plated, etc.

Figure 3:
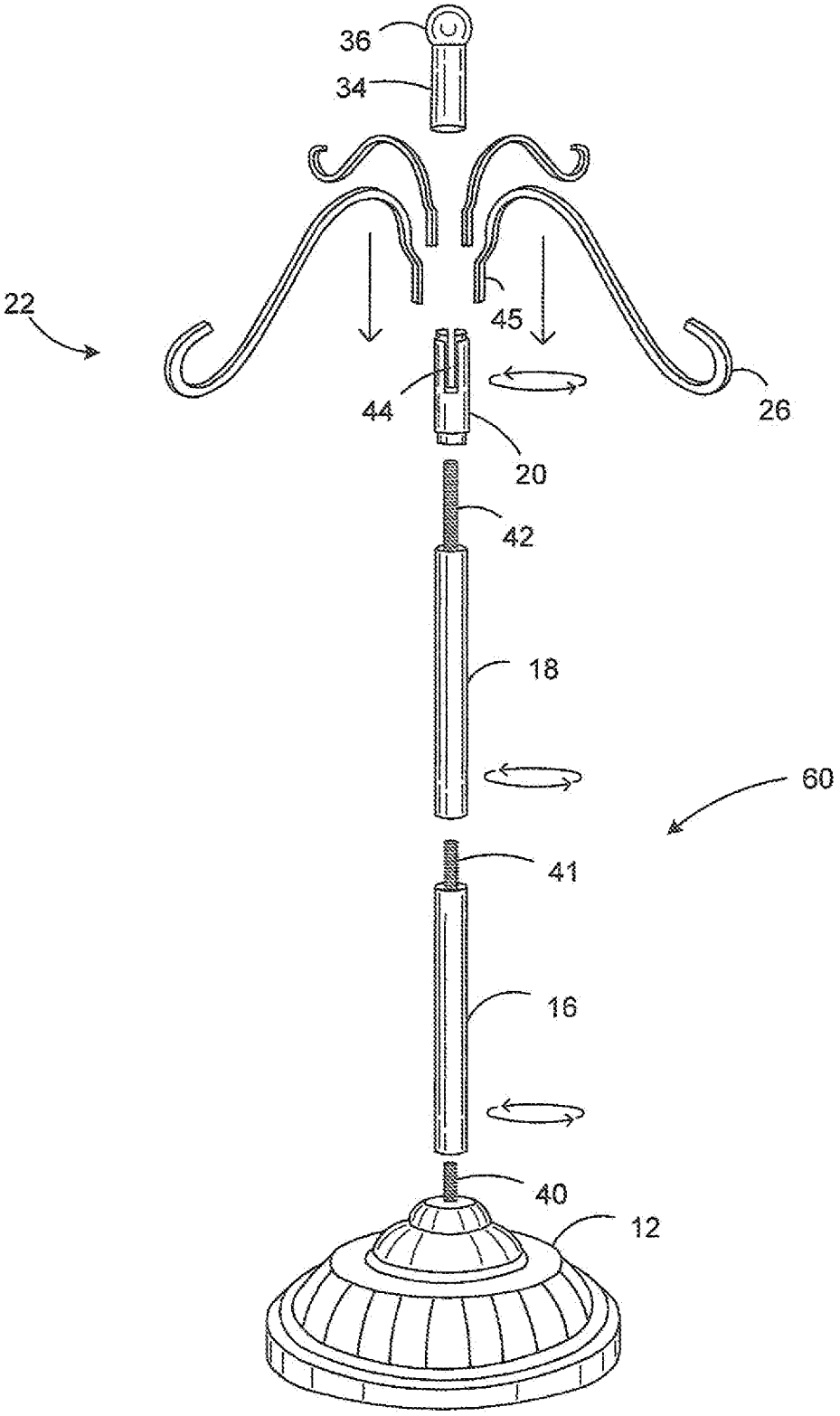
FIG. 3 is an exploded side view of the ornament tree assembled with two tiers of hook members.

FIG. 3 illustrates an ornament tree 60 constructed with a single tier 22. Here, the bottom support rods are 16 and 18 are threaded together and then threaded onto the threaded stud 40 of the base 12. The single tier 22 of hook members 26 is assembled in the same manner as set forth above in connection with FIG. 2. Rather than assembling a second tier 24, the finial 34 is threaded onto the threaded stud 42 to thereby capture the castellated collar 20 and the inner ends 45 of the hook members 26 and anchor the same to the single tiered ornament tree 60. The single tier ornament tree 60 can employ the same components as are used with the two tier ornament tree 10 of FIG. 2.

Figure 4:
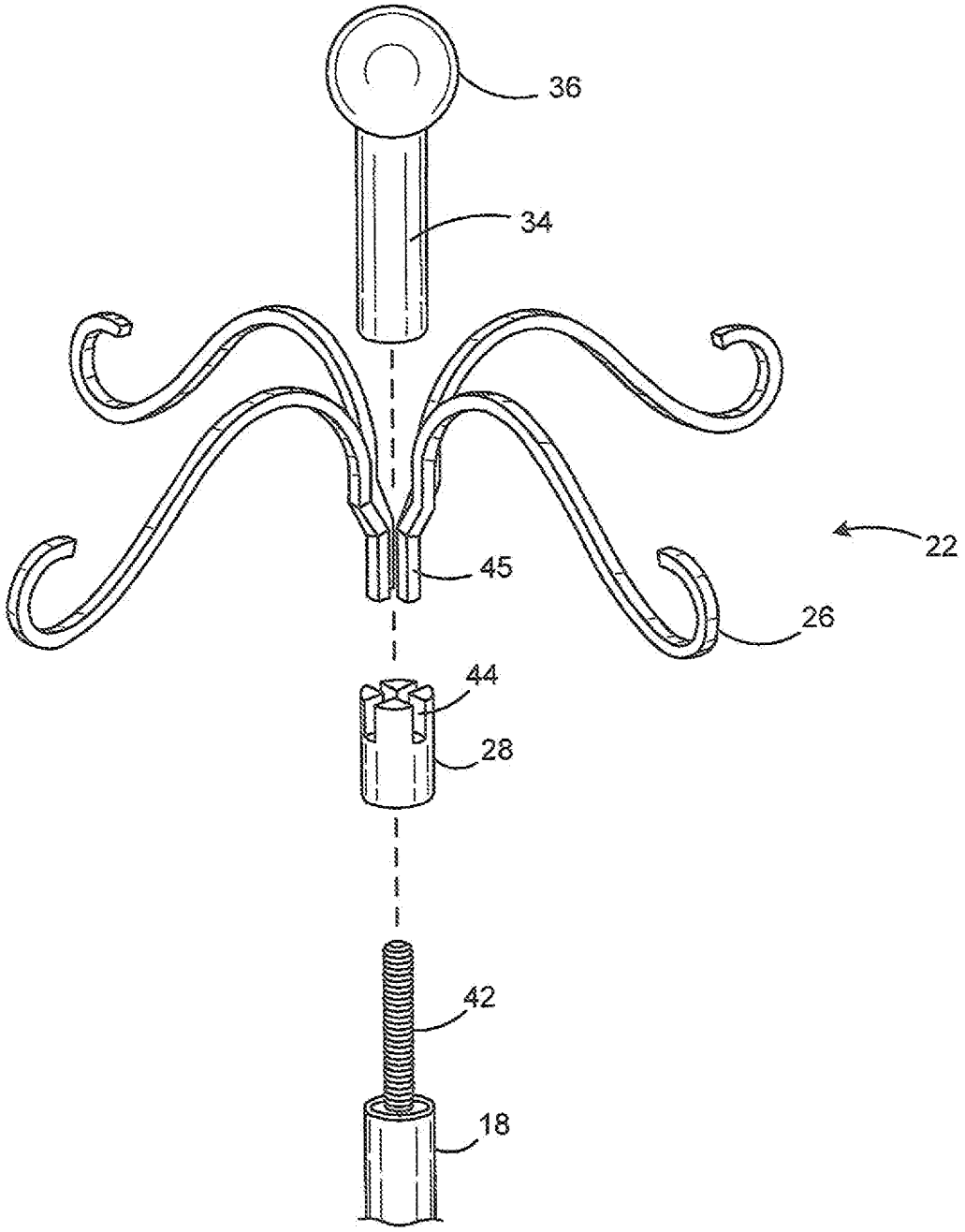
FIG. 4 is an exploded and enlarged view of the various components of a tier of the ornament tree constructed according to an embodiment of the invention.

FIG. 4 is an isometric side view showing in exploded form the components that involve the castellated collar 28. The castellated collar 28 has a central bore that fits over the threaded stud 42 of the underlying support rod 18. There are four, three-sided channels (not shown in FIG. 4) that are rectangular in cross section that extend vertically through the castellated collar 28 for insertion therein of the inner rectangular ends 45 of the hook members 26. When inserted, an angled portion of each hook member 26 extends through a respective slot 44. Also when the castellated collar 28 is inserted over the threaded stud 42, the upper end of the threaded stud 42 extends beyond the top of the castellated collar 28. When the castellated collar 28 is populated with the inner ends 45 of the hook members 26, the finial 34 is then threaded onto the exposed top of the threaded stud 42 and down onto the top edge of the castellated collar 28. If the hook member tier 26 is the first of several tiers, then a third support member 20 can be threaded onto the exposed end of the threaded stud 42, which then captures the hook members 26 in the castellated collar 28. With this arrangement, the hook members 26 are not only prevented from vertical movement and horizontal movement, but also prevented from wobbling in the castellated collar 28. It should be understood that the hook members 26 remain rigidly attached to the castellated collar 28, but can also be removed therefrom if replacement is needed. Importantly, the entire assembly of the tiered ornament tree 10 is shipped in component form so that the packing thereof is more efficient, and the breakage of the components during shipment is much less likely, as compared to the shipment of the fully assembled ornament tree, as is the case with many ornament trees known in the prior art.

Figure 5A:
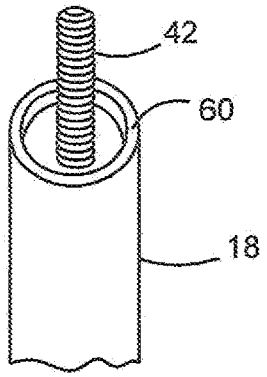
FIG. 5*a* illustrates the threaded stud formed at one end of a support rod.
Figure 5B:
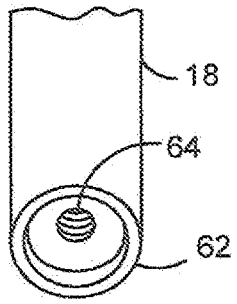
FIG. 5*b* illustrates the threaded bore formed at the other end of the support rod.

FIGS. 5*a* and 5*b* illustrate the opposite ends of each of the support rods 16, 18 and 20, all of which are fabricated in the same manner. The support rod 18, for example, is fabricated preferably with a metal rod, and fabricated with a skirt at both ends. The top end is formed with a skirt 60, and a bottom end is formed with a similar skirt 62. Also formed or machined in each end of the rod is a central bore which is threaded. The threaded bore located at the bottom end of the rod is identified as numeral 64. A threaded stud 42 is threaded into the threaded bore located at the top of the support rod 18. The threaded stud 42 is sufficiently long as to extend well beyond the top end of the rod 18. This assembly constitutes a support rod according to a preferred embodiment of the invention.

Figure 6A:
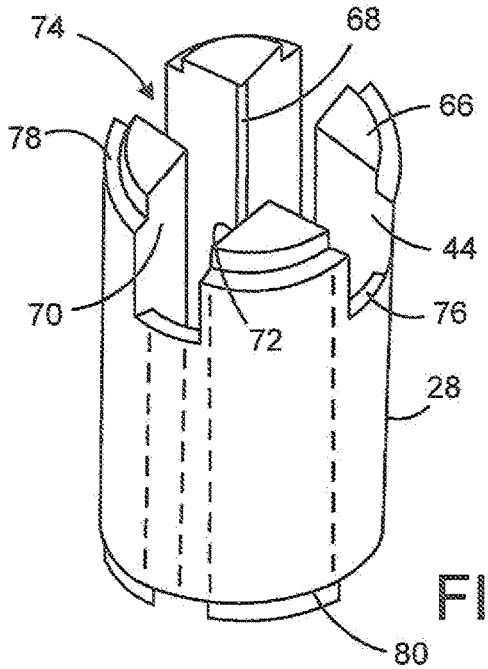
FIG. 6*a* is an isometric side view of a top end of the castellated collar.
Figure 6B:
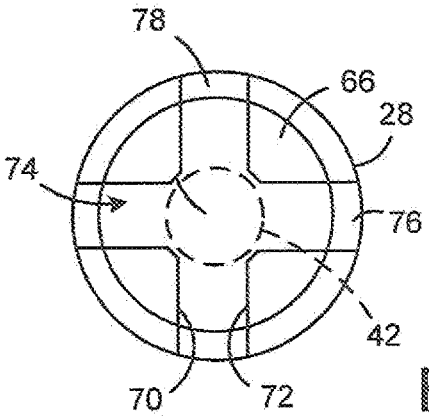
FIG. 6*b* is a bottom end view of the castellated collar of FIG. 6*a;*
Figure 6C:
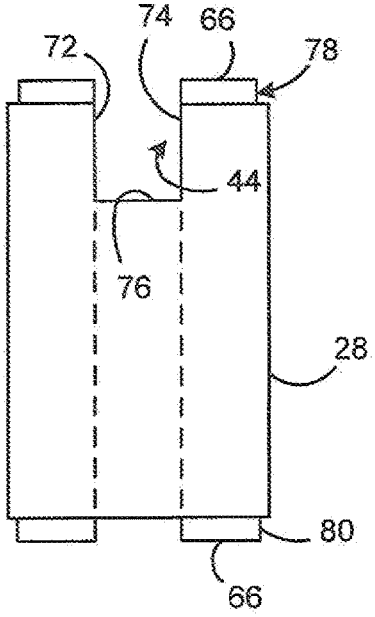
FIG. 6*c* is a side view of the castellated collar of FIG. 6*a;*

Referring now to FIGS. 6*a*-6*c*, there are illustrated the details of the castellated collar 28. The castellated collar 28 is fabricated by machining a metal workpiece, but casting techniques can be employed using molds. The body of the castellated collar 28 is generally cylindrical on the outside surface, and includes the slots 44 formed in the top edge. In the preferred embodiment, four slots 44 are formed ninety degrees apart, but those skilled in the art may prefer to fabricate the castellated collar 28 with a different number of slots 44 so that a different number of hook members 26 can be utilized. Each slot 44 is bounded on its opposite sides with an inwardly directed protrusion 66 that is pie-shaped in cross section. Each protrusion 66 extends from the top of the castellated collar 28 to the bottom thereof. The outer cylindrical surface of the castellated collar 28 can be considered a shell with the protrusions formed therein. The radial inner edge 68 is vertically elongate and forms the "bore" through which the threaded stud 42 extends. The castellated collar 28 does not have threads in the preferred embodiment. This allows one to rotate the collar 28 on the threaded stud 42 at any angular position so that the hook members 26 radiate outwardly in a desired orientation. This feature allows the first tier 22 to be assembled so that the four hook members 26 extend outwardly at, for example, 0 degrees, 90 degrees, 180 degrees and 270 degree positions. The second tier 24 can be arranged so that the four hook members 30 radiate outwardly at, for example, 45 degrees, 135 degrees, 225 degrees and 315 degree positions. With this arrangement, the hook members of the second tier 24 do not directly overlie the hook members of the first tier 22.

The elongate vertical sidewalls 70 and 72 of two neighbor protrusions 66 form an elongate vertical channel 74 that generally forms three sides of a rectangular (in cross section), as illustrated in FIG. 6*b*. A rectangular cross-sectional size of the channel 74 is somewhat larger than the cross-sectional size of the inner end 45 of a hook member 26. In practice, the internal fourth side of the rectangle constitutes the threaded stud 42. Thus, the inner end 45 of a hook member 26 snugly fits within a respective channel 74. The channel 74 opens radially outwardly to the outer cylindrical surface of the body of the collar 28 at the top thereof to form the slot 44. Below the bottom of the slot 44, the channel is closed to the outer cylindrical surface of the body of the collar 28. Thus, the slot 44 has a bottom lateral surface 76 which engages the angled portion (84 of FIG. 7) of the inner end 45 of the hook member 26 when inserted therein.

The top outer annular edges of each protrusion 66 are formed with an annular relief 78. The top annular relief 78 of the castellated collar 28 fits into the annular skirt 62 of the bottom end of the overlying support rod if multiple tiers are employed, or the bottom annular skirt of the finial if it is used. Similarly, the bottom annular edge of each protrusion 66 is formed with an annular relief 80 to fit within the top skirt 60 of the underlying support rod. The purpose of the annular skirts is thus to form an annular receptacle within the end of each support rod to receive therein the portions of the protrusions 66 that extend beyond the cylindrical outer shell of the castellated collar 28. This provides a more sturdy interconnection between the upper and lower support rods to the castellated collar 28 and flexing of the support rods at the interconnections. The vertical alignment of the support rods is thus made more stable and repeatable.

Figure 7:
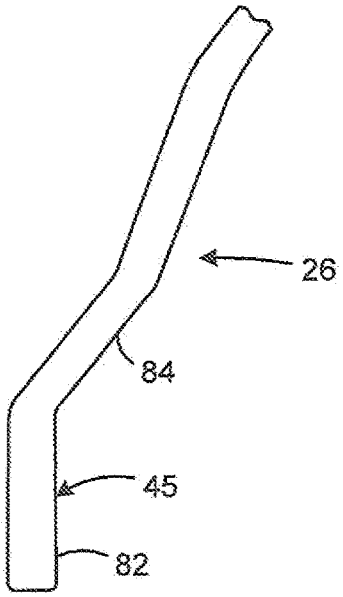
FIG. 7 is a side view of the inner end portion of a hook member.

The inner end 45 of one hook member 26 is illustrated in FIG. 7. Here, the inner end 45 is constructed with a vertical part 82 that is rectangular in cross section and fits within the rectangular-shaped channel 74 of the castellated collar 28. The top portion of the vertical part 82 extends to an angled part 84 that extends through the slot 44 of the castellated collar 28. The top portion of the angled part 84 extends upwardly and then is curved down and to a hook, as shown in FIG. 4. Beyond the vertical part 82, which is rectangular in cross section, the outer part of the hook member 26 can be fabricated with different cross-sectional shapes. The hook member 26 can be fabricated of metal and formed and bent with various angles and shapes to satisfy the needs of the manufacturer.

Figure 8:
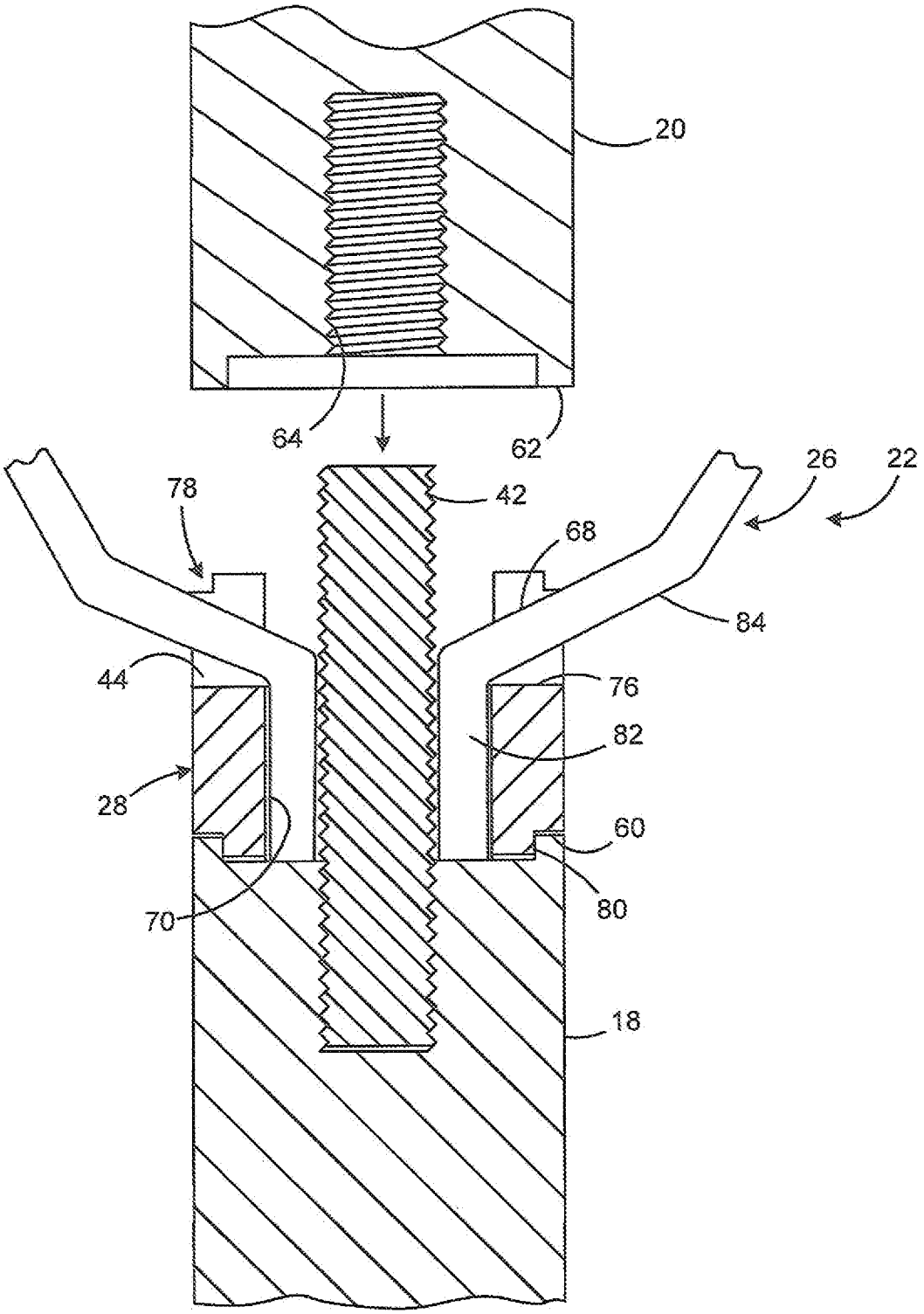
FIG. 8 is an enlarged view of the collar as engaged with the inner ends of the hook members, as well as engaged with the lower and upper support rods.

FIG. 8 is a cross-sectional view of the castellated collar 28 and associated components once assembled together. The castellated collar 28 is first inserted over the threaded stud 42 of the underlying support rod 18 until the top annular skirt 60 of the support rod 18 engages within the bottom relief 80 of the castellated collar 28. Then, the vertical part 82 of the hook members 26 are inserted into the respective elongate vertical channels 74 of the castellated collar 28. The vertical parts 82 are lowered into the channels 74 until either bottomed out on the top end of the support rod 18, or until bottom out by engagement of the angled part 84 on the bottom 76 of the slot 44. Once the vertical parts 82 of the inner ends 45 of the hanger members 26 are inserted into the respective channels 74, the threaded bore 64 in the bottom end of the overlying support rod 20 is threaded onto the threaded stud 42 over which the collar 28 is inserted. The overlying support rod 20 is rotated until the bottom skirt 62 thereof bottoms out in the top annular relief 78 of the collar 28. The inner ends 45 of each of the hook members 26 are thus captured against vertical removal. As noted above, the width of the collar slots 44 is only a little larger than the corresponding width of the hook member inner ends 45, whereby the inner ends 45 cannot move or wobble sideways. Additional tiers can be added on top of the underlying tiers by repeating the above steps with additional components.

Figure 9:
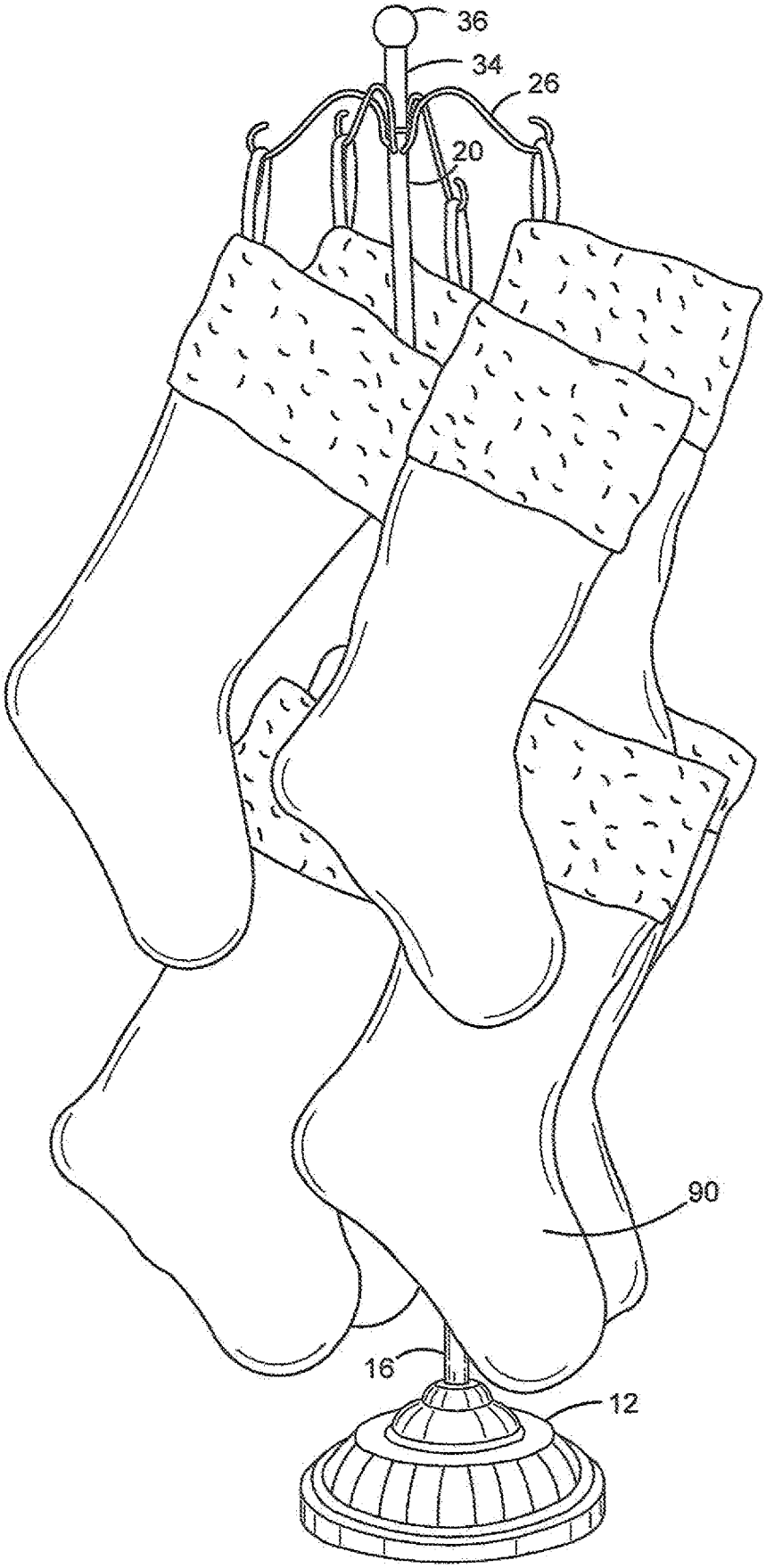
FIG. 9 is a side view of the tiered ornament tree with ornaments hung therefrom.

The tiered ornament tree 10 of the invention can be utilized to display many types of ornaments. In FIG. 9, there is illustrated the display of eight Christmas stockings, one identified as numeral 90. The first tier 22 of four hook members is utilized to hang four Christmas stockings 90. A second tier 24 of four hook members is utilized to hang another four Christmas stockings 90. The tiered ornament tree 10 of the invention is adapted for hanging and displaying not only Christmas stockings, but also many other types of holiday and non-holiday decorations. Rather than displaying ornaments, the tiered ornament tree 10 can be used to hang necklaces and the like so that they remain individualized and not comingled together or tangled in a drawer. Ornaments other than holiday items can be hung from the tiered ornament hanger 10, including necklaces, watches, rings, charm bracelets and other jewelry, and many other objects and items.

While the preferred and other embodiments of the invention have been disclosed with reference to a specific embodiment of a tiered ornament tree, and the various components thereof, and associated methods of fabrication thereof, it is to be understood that many changes in detail may be made as a matter of engineering choices without departing from the spirit and scope of the invention, as defined by the appended claims.

What is claimed is:

1. An ornament tree, comprising:

a base adapted for resting on a support surface;

a male/female threaded rod, said rod is attached to said base;

a collar attachable to a top end of said male/female rod, said collar having one or more vertical slots formed therein, each said vertical slot having an open top, and said collar having a non-threaded bore formed vertically and centrally therethrough;

one or more hook members, each said hook member adapted for engaging with an ornament, and each said hook member having an inner end adapted for insertion in a respective slot of said collar;

a finial threadably attached to the top end of said threaded rod, said finial for capturing the inner ends of said hook members within the respective vertical slots of said collar to prevent vertical removal of the inner ends of said hook members via the open tops of the respective slots of said collar; and a connecting threaded screw extending all the way through the central non-threaded bore of said collar, said connecting threaded screw is threadably attached to a top end of said threaded rod, and said connecting threaded screw is threadably attached to a bottom end of said finial so that said collar is located vertically between said finial and said threaded rod.

2. The ornament tree of claim 1, wherein each said hook member is constructed with a corner at the inner end thereof, and said finial directly engages the respective corners of said one or more hook members to prevent the inner ends of said hook members from being removed upwardly from the respective vertical slots of said collar.

3. The ornament tree of claim 2, wherein the inner end of each said hook member is constructed with a downwardly depending portion and with a bottom end, said downwardly depending portion having a top that has an outwardly angled part that forms said corner, and then said outwardly angled part is angled again upwardly.

4. The ornament tree of claim 1, wherein said collar comprises a cylinder, and a top annular edge thereof is castellated with said slots formed in said top annular edge thereof.

5. The ornament tree of claim 1, wherein said threaded rod has an annular skirt at a top edge thereof, and a bottom edge of said collar has an annular relief for receiving therein the annular skirt of said threaded rod.

6. The ornament tree of claim 4, wherein each castellation of said collar is constructed with a top having a portion of an annular relief.

7. The ornament tree of claim 1, wherein said male/female threaded rod is constructed with said connecting threaded screw at a top thereof, and is constructed with a female threaded bore at a bottom thereof.

8. The ornament tree of claim 7, wherein said connecting threaded screw has a diameter smaller than a diameter of a body of said threaded rod.

9. The ornament tree of claim 1, wherein each said hook member is shaped so as to have a vertical downwardly depending inner part connected to an angled part of said hook member, and then each said hook member is curved downwardly and then at a respective outer end curved upwardly to support a respective ornament thereon.

10. The ornament tree of claim 1, wherein said threaded rod defines a first threaded rod, and further including a second threaded rod threadably connected to said first threaded rod, a bottom end of said first threaded rod is connected to a top end of said second threaded rod, and a bottom end of said second threaded rod is threadably connected to said base.

11. The ornament tree of claim 1, wherein the inner end of each said hook member includes a downwardly depending part, and said downwardly depending part is insertable downwardly into a respective channel, where each said channel is formed by three sidewalls in each said slot of said collar, and a fourth side of each said channel is formed by connecting threaded screw fastened to a top of said threaded rod.

12. An ornament tree, comprising:

a base adapted for resting on a support surface;

a finial located at a top of said ornament tree;

a plurality of threaded rods, each said threaded rod having at one end a threaded bore and at an opposite end a threaded stud, said plurality of threaded rods threadably connected in series, a bottommost threaded rod of said plurality of threaded rods is threadably connected to said base, and a topmost threaded rod of said plurality of threaded rods is threadably connected to said finial;

one or more tiers of hook members, where each said tier includes:

a respective cylindrical collar insertable over a threaded stud of a threaded rod of said plurality of threaded rods, said collar being castellated and having one or more vertical slots formed in an annular edge of said collar;

a set of hook members, each said hook member having an outer end adapted for engaging with an ornament, and each said hook member having an inner end adapted for insertion in a respective slot of said cylindrical collar; and a threaded bore of one of a) a threaded rod of said plurality of threaded rods or b) said finial, that is threadably attached to the threaded stud over which said cylindrical collar is inserted to cap an end of each said slot and thereby capture the respective inner ends of said hook members in said respective cylindrical collar.

13. The ornament tree of claim 12, wherein the inner end of each said hook member is formed with a vertical part, and further including a four-sided channel defined by three vertical sidewalls formed in each said cylindrical collar, and b) a vertical surface of each threaded stud of said plurality of threaded rods of each said tier, and wherein the vertical part of each said hook member is insertable into a respective said four-sided channel.

14. An ornament tree, comprising:

a base adapted for resting on a support surface;

a plurality of threaded rods forming a vertical support for said ornament tree, at least two of said threaded rods having at one end a threaded stud and at an opposite end a threaded bore, a bottommost of said threaded rods of said plurality being fastened to said base;

a tiered arrangement of at least two sets of hook members, each said hook member of each set adapted for engaging with an ornament, said tiered arrangement including:

a) a first tier which includes:

a first tubular castellated collar having vertical slots in a top end thereof, said first tubular castellated collar insertable onto the threaded stud of a first threaded rod of said at least two threaded rods, a first set of hook members, each hook member of said first set having an inner end insertable in a respective slot of said first tubular castellated collar;

b) a second tier which includes:

a second tubular castellated collar having vertical slots in a top end thereof, said second tubular castellated collar insertable onto the threaded stud of a second threaded rod of said at least two threaded rods, a second set of hook members, each hook member of said second set having an inner end insertable in a respective slot of said second tubular castellated collar;

the threaded bore of said second threaded rod threadably attached to the threaded stud of said first threaded rod to thereby capture the first tubular castellated collar between said first and second threaded rods;

a threaded member having a threaded bore threadably attached to the threaded stud of said second threaded rod to thereby capture the second tubular castellated collar between said second threaded rod and said threaded member.

15. The ornament tree of claim 14, wherein said threaded member comprises a finial.

16. The ornament tree of claim 14, wherein said first and second castellated collars each have a vertical three-sided channel, and a threaded stud of a respective threaded rod extending through said castellated collars forming a fourth side, said three-sided channel of each said castellated collar and said respective threaded studs forming respective four-sided channels.

17. The ornament tree of claim 16, wherein a respective said vertical three-sided channel extends from one end of each said first and second castellated collars to an opposite end of each said first and second castellated collars.

18. The ornament tree of claim 16, wherein the inner ends of the first set of hook members includes a downwardly depending part that is insertable into a respective four-sided channel of said first castellated collar, and wherein the inner ends of the second set of hook members each include a downwardly depending part that is insertable into a respective four-sided channel of said second castellated collar.

19. The ornament tree of claim 18, wherein said first and second castellated collars each have an annular relief formed at each end thereof, and a respective annular skirt formed at the ends of said threaded rods fits within a respective annular relief of said first and second castellated collars.

20. The ornament tree of claim 14, wherein said first and second castellated collars each have an annular relief formed at each end thereof, and a respective annular skirt formed at the ends of said threaded rods fits within a respective annular relief of said first and second castellated collars.

* * * * *